US010765195B2

(12) United States Patent
Tamagnini

(10) Patent No.: US 10,765,195 B2
(45) Date of Patent: Sep. 8, 2020

(54) SHOULDER SUPPORT FOR A MOTOR

(71) Applicant: EMAK S.P.A., Bagnolo In Piano (RE) (IT)

(72) Inventor: Luca Tamagnini, Bagnolo In Piano (IT)

(73) Assignee: EMAK S.P.A., Bagnolo In Piano (RE) (IT)

( * ) Notice: Subject to any disclaimer, the term of this patent is extended or adjusted under 35 U.S.C. 154(b) by 0 days.

(21) Appl. No.: 16/343,178

(22) PCT Filed: Oct. 24, 2017

(86) PCT No.: PCT/IB2017/056590
§ 371 (c)(1),
(2) Date: Apr. 18, 2019

(87) PCT Pub. No.: WO2018/087615
PCT Pub. Date: May 17, 2018

(65) Prior Publication Data

US 2019/0313775 A1 Oct. 17, 2019

(30) Foreign Application Priority Data

Nov. 8, 2016 (IT) ..... 102016000112131

(51) Int. Cl.
*A45F 3/00* (2006.01)
*A45F 3/08* (2006.01)

(52) U.S. Cl.
CPC ..... *A45F 3/08* (2013.01); *A45F 2003/003* (2013.01); *A45F 2200/0575* (2013.01)

(58) Field of Classification Search
CPC . A45F 3/08; A45F 3/10; A01D 34/905; B05B 7/1427; B05B 9/0855
See application file for complete search history.

(56) References Cited

U.S. PATENT DOCUMENTS 4,582,165 A * 4/1986 Latini ..... A01M 31/02 108/152
4,600,129 A * 7/1986 Kondo ..... A01M 7/0017 222/175

(Continued)

FOREIGN PATENT DOCUMENTS

EP 0887005 A1 12/1998
EP 1577602 B1 3/2008

(Continued)

*Primary Examiner* — Brian D Nash
(74) *Attorney, Agent, or Firm* — Volpe and Koenig, P.C.

(57) ABSTRACT

Shoulder support for a motor includes: a back-plate which is adapted for being associated with the back of an operator through shoulder straps and includes a shaped body to contact with the back of the operator to which a frame is fixed, the frame being substantially L-shaped and includes a first portion, fixed to the back-plate, and a second portion undercut with respect to the first portion and comprising a through opening with substantially vertical through axis, the motor being connected at the top the of second portion; a connection body adapted for being rigidly connected to the motor; and a resilient support element adapted for connecting the connection body to the frame in a floating manner inside a seat defined by the through opening. The resilient support element includes a plurality of springs, having axes, which lay on a plane adapted for being arranged transversally to a vertical direction.

10 Claims, 3 Drawing Sheets

(56) References Cited

U.S. PATENT DOCUMENTS

| | | | | | |
|---|---|---|---|---|---|
| 4,651,903 | A * | 3/1987 | Pagliai | A01M 7/0046 | 222/175 |
| 4,658,778 | A * | 4/1987 | Gamoh | B05B 7/1413 | 123/195 C |
| 4,934,573 | A * | 6/1990 | Jaeger | A45F 3/08 | 224/153 |
| 5,553,759 | A * | 9/1996 | McMaster | A45F 3/08 | 224/259 |
| 5,829,874 | A | 11/1998 | Breeding | | |
| 6,047,668 | A * | 4/2000 | Yamamoto | A01D 34/902 | 123/195 A |
| 6,053,259 | A * | 4/2000 | Kojima | A01D 34/902 | 173/171 |
| D426,700 | S * | 6/2000 | Gregory | D3/216 | |
| 6,619,523 | B1 | 9/2003 | Duckworth | | |
| 7,703,645 | B2 * | 4/2010 | Moskun | A45F 3/08 | 224/579 |
| 2018/0303227 | A1 * | 10/2018 | Simione | A45F 3/08 | |

FOREIGN PATENT DOCUMENTS

| | | | |
|---|---|---|---|
| WO | 9409674 | A1 | 5/1994 |
| WO | 2013104338 | A1 | 7/2013 |

* cited by examiner

SHOULDER SUPPORT FOR A MOTOR

TECHNICAL FIELD

The present invention concerns a shoulder support for a motor. More specifically, the present invention refers to a shoulder support, of the backpack type, for a motor actuating a tool like, for example, a strimmer, a hedge trimmer, a pruner, a blower/aspirator, an atomizer or other gardening tools.

PRIOR ART

As known, in order to carry out some gardening operations, portable devices are often used. For example, to cut shrubs, bushes and grass in difficult-to-reach locations strimmers, in particular so-called shoulder-harnessed strimmers.

The devices of the prior art comprise a gardening tool actuated by a power group that comprises a motor connected to a shoulder support that the operator wears through shoulder straps.

The shoulder support foresees a back-plate fixed to the shoulder straps, and a frame for supporting the motor fixed to the back-plate.

The shoulder support comprises a connection body, for the connection of the motor to the frame, connected to the frame by means of at least one resilient support element that allows the oscillation of the connection body with respect to the frame itself.

Thanks to such a provision it is possible to limit or prevent the transmission of the vibrations of the motor to the operator.

However, during use of the strimmer, both with the motor operating and with the motor turned off, due to the oscillations of the motor the centre of mass of the assembly formed by the motor and the shoulder support can change and move with respect to the frame.

Moreover, the resilient support element of the connection body is subjected to substantial shearing stresses that can cause early wearing and breaking thereof.

There is therefore a need to limit the stresses acting on the resilient element so as to limit the maintenance interventions of the resilient element itself.

The purpose of the present invention is to provide a shoulder support for a motor having structural and functional characteristics such as to avoid the aforementioned drawback with reference to the prior art, in the context of a simple and rational constructive solution.

Such purposes are accomplished by the characteristics of the invention given in the independent claim. The dependent claims outline preferred and/or particularly advantageous aspects of the invention.

SUMMARY OF THE INVENTION

The invention, particularly, provides a shoulder support for a motor comprising a frame, a connection body adapted for being rigidly connected to the motor and a resilient support element adapted for connecting the connection body to the frame.

According to the invention, the shoulder support comprises an abutment element configured to limit an oscillation of the connection body with respect to the frame.

Thanks to such a solution, it is possible to limit the oscillation of the connection body (and with it of the motor) with respect to the frame improving the stability of the shoulder support and of the operator.

Moreover, by limiting the oscillation of the connection body with respect to the frame, the stress that acts on the resilient support element is reduced, reducing the wearing thereof and limiting the need for maintenance interventions.

According to an aspect of the invention, the abutment element can be configured to limit the oscillation of the connection body with respect to a substantially vertical direction.

In this way, it is possible to limit specific stresses acting on the resilient support element of the connection body, for example the shearing stresses.

In particular, thanks to such a solution it is possible to limit the stresses acting on the resilient support element that in use are accentuated by the weight force acting on the motor.

According to another aspect of the invention the frame can be L-shaped and can comprise a first portion (at the back and substantially vertical in use) and a second portion (substantially horizontal in use) undercut with respect to the first portion. Moreover, the connection body and the abutment element can be connected to the second portion.

Thanks to such a solution a shoulder support is provided of simple design and manufacture. Moreover, the abutment element is made with a robust, efficient, rational and low-cost solution, located close to the resilient support element to be limited.

Moreover, the second portion of the frame can comprise a through opening and the connection body can be vertically aligned with the through opening and, moreover, the abutment element can be configured to at least partially block the through opening.

In this way, in use, the abutment element is on the trajectory followed by the connection body during the oscillation with respect to the frame so as to effectively limit the oscillation (vertical, i.e. substantially parallel to the through axis of the opening) of the connection body itself.

According to a further aspect of the finding, the abutment element is fixed to the second portion of the frame on the opposite side with respect to the motor.

In this way the abutment element is adapted for effectively counteracting the vertical thrust due to the weight force and to the vibrations of the motor making contact with the connection body on the opposite side to the part of the connection body facing the motor without the need for structural modifications of the connection between motor and connection body.

According to another aspect, the abutment element can be arranged a distance from the connection body comprised between 3 mm and 6 mm.

In this way, it is possible to contain the size of the oscillation of the connection body below a limit value so as to avoid excessive stresses on the resilient support element.

According to another aspect of the invention the abutment element can comprise a plate fixed to the frame.

Thanks to such a solution, the abutment element is made with a robust, efficient, rational and low-cost solution.

According to another aspect, the plate can be equipped with a central hole.

In this way, it is possible for an operator to access the connection body to carry out installation and/or maintenance operations of the connection between the motor and the connection body.

According to a further aspect of the invention, the resilient support element can comprise a spring (or a plurality of springs).

In this way, the connection body is suspended in oscillation at the frame by means of simple, effective and low-cost resilient support elements.

A further aspect of the invention provides a power group comprising a shoulder support as described above and a motor connected to the connection body of the shoulder support.

BRIEF DESCRIPTION OF THE DRAWINGS

Further characteristics and advantages of the invention will become clearer from reading the following description provided as a non-limiting example, with the help of the figures illustrated in the attached tables.

BEST EMBODIMENT OF THE INVENTION

Figure 1:
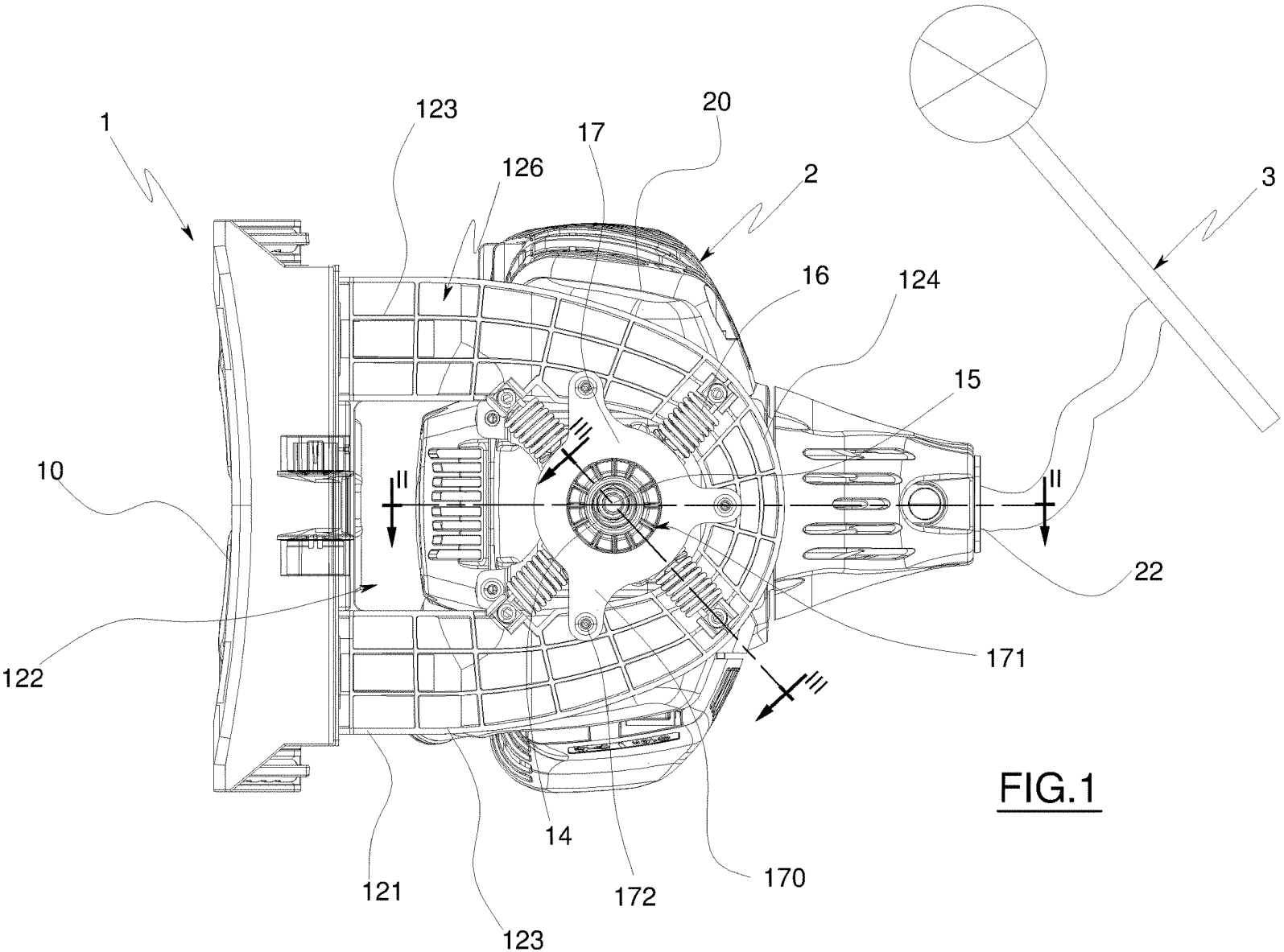
FIG. 1 is a view from below of the shoulder support and of the motor group.

With particular reference to such figures, a shoulder support for supporting a motor 2 adapted for actuating a gardening tool 3, of the type known in the field, like for example a strimmer, a hedge trimmer and similar tools is globally indicated with 1.

The motor 2 can be of any type adapted for the actuation of the gardening tool 3, for example of the endothermal or electric type, and is contained in a case 20 equipped with a lower portion 21 connected to the shoulder support 1, as will be described more clearly hereinafter.

Moreover, the motor 2 is equipped with a power take off 22 connected to the gardening tool 3.

For the purposes of the present invention the components and the operation of the gardening tool 3 will not be illustrated in detail since they are already known by those skilled in the art.

The shoulder support 1 comprises a back-plate 10 for example substantially rigid, which is adapted for being associated with the back of an operator through shoulder straps 11.

The back-plate 10 comprises a shaped body to come into contact with the back of the operator to which a frame 12, for example substantially rigid, is fixed, which is adapted for supporting the motor 2.

Figure 2:
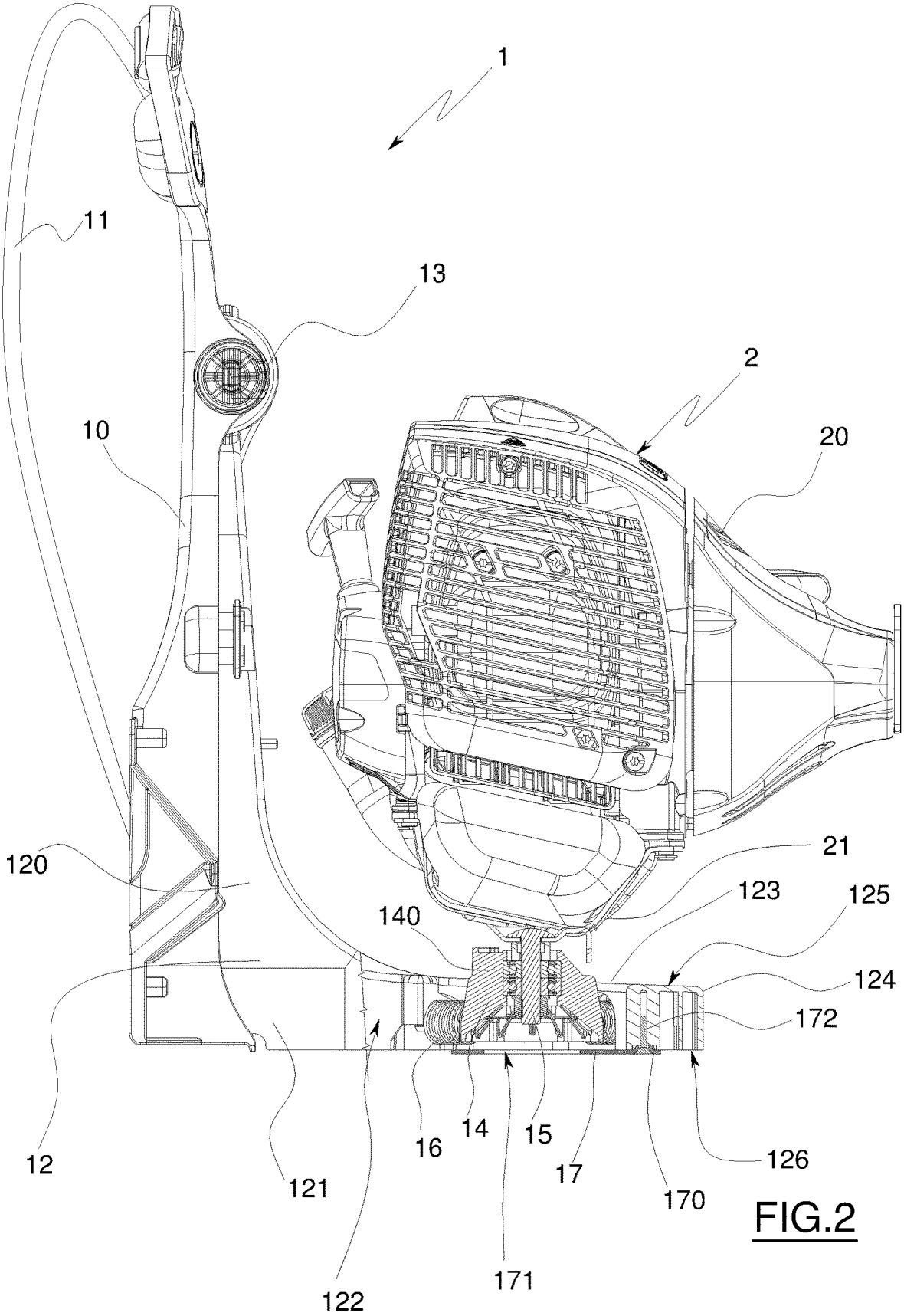
FIG. 2 is the section according to the plane II-II of FIG. 1.
Figure 3:
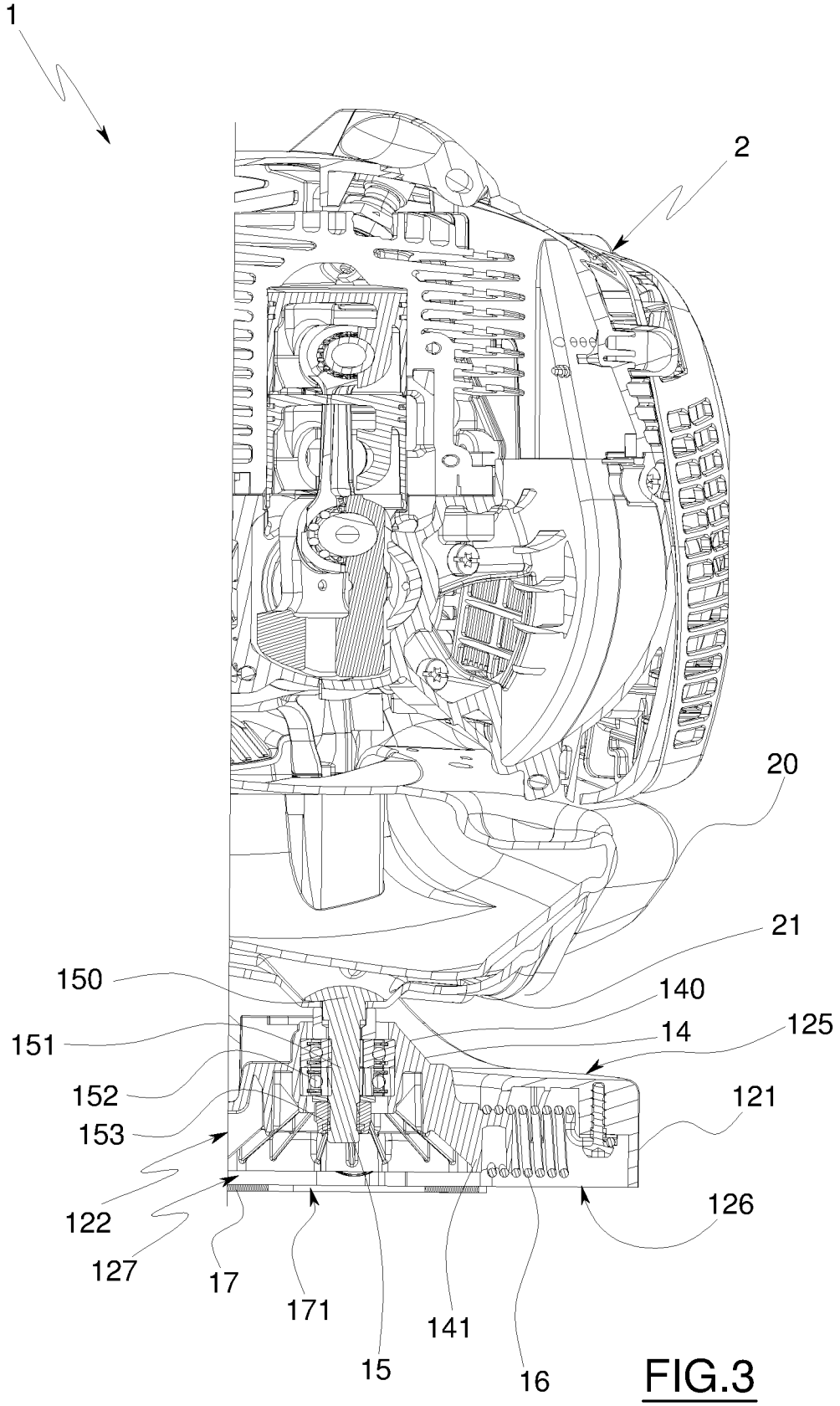
FIG. 3 is an enlargement of the section according to the plane III-III of FIG. 1.

With reference to FIG. 2, the frame 12 is fixed to the back-plate 10 in a removable manner through engagement/disengagement means 13, for example of the type described in European Patent EP 1 577 602 B1 to the same Applicant and referred to as a whole here for reference.

In practice, the engagement/disengagement means 13 are such as to allow the operator to quickly release the frame 12 and the motor 2 from the back-plate 10 when needed, for example in the case of a fire of the motor 2 itself.

According to other embodiments not shown, the frame 12 can be irremovably fixed to the back-plate 10, for example not ruling out the possibility that the back-plate 10 and the frame 12 can be made in a single piece.

With reference to FIG. 2, the frame 12 is substantially L-shaped and comprises a first portion 120, fixed to the back-plate 10, and a second portion 121 undercut with respect to the first portion 120 and to which the motor 2 is connected at the top.

In particular, in use, the first portion 120 is adapted for being arranged substantially vertically (i.e. substantially parallel to the plane of the back-plate 10), whereas the second portion 121 is adapted for being arranged substantially horizontally (i.e. substantially perpendicular to the plane of the back-plate 10).

In the illustrated example, the frame 12 is made in a single piece, for example by moulding of plastic materials.

This does not rule out the possibility that in other embodiments the first portion 120 and the second portion 121 of the frame 12 can be made in separate bodies.

The first portion 120 of the frame 12 has a profile tapering upwards and is equipped with a lower end constrained to the second portion 121 and a free upper end for example equipped with gripping means.

The engagement/disengagement means 13 are for example connected in an area of the first portion 120 intermediate between the free end and the constrained end thereof.

The second portion 121 of the frame 12 comprises a through opening 122 with substantially vertical through axis (i.e. parallel to the plane of the back-plate 10).

The through opening 122 defines a housing seat for a connection body 14 that allows the connection of the motor 2 to the frame 12.

The motor 2 is, therefore, supported by the connection body 14 substantially vertically aligned with the through opening 122.

With particular reference to FIG. 1, the second portion 121 of the frame 12 comprises a pair of parallel and spaced prongs 123 between which the through opening 122 is defined.

Each prong 123 is fixed canti-levered to the first portion 120 of the frame 12 and is equipped with a first end constrained to the first portion 120 itself and a second free end.

In particular, in the illustrated example, the prongs 123 are constrained to one another by a curved cross member 124 fixed to the free ends of each prong 123.

In practice, the prongs 123, the curved cross member 124 and the first portion 120 of the frame 12 delimit the through opening 122 of the second portion giving them a substantially a doughnut shape, for example ogival or oval.

The connection body 14 is vertically aligned with the through opening 122 of the second portion 121 of the frame 12, for example inserted with enough radial clearance inside the substantially cylindrical space defined by the through opening 122.

In the illustrated example, the connection body 14 is partially received in the seat defined by the through opening 122, i.e. it is at least partially contained in the axial bulk of the through opening 122.

In greater detail, the figures illustrate the connection body 14 in a rest position in which it is at least partially contained in the axial bulk of the through opening 122 so as to project at the top with respect to an upper surface 125 of the second portion 121 of the frame 12.

Moreover, in the illustrated example, the connection body 14 is arranged a non-zero distance from the plane on which a lower surface 126 of the second portion 121 of the frame 12 lies, i.e. between a lower end of the connection body 14 and the lower surface 126 of the second portion 121 of the frame 12 an interspace 127 is defined.

The connection body 14 is adapted for being rigidly connected to the motor 2, in particular to the lower portion 21 of the case 20.

The connection body 14 comprises a substantially conical or cylindrical central stump 140, from which a plurality of radial projections 141 extends with respect to an axis of the connection body 14 itself passing through the central stump 140 and adapted, in use, for being arranged substantially vertically.

In the illustrated example the radial projections 141, four in number, are arranged equally angularly spaced apart around the central stump 140, and are adapted for allowing the connection of the connection body 14 to the frame 12 as will be described more clearly hereinafter.

In the central stump 140 of the connection body 14 a through bush (in the axial direction) is formed that is adapted for receiving a fastening pin 15 of the motor 2.

The pin 15 comprises a head 150 fixed to the lower portion 21 of the case 20 of the motor 2, and a stem 151 received in the through bush of the central stump 140, of the connection body 14, for example through the interposition of one or more ball bearings 152.

The stem 151 of the pin 15 comprises a threaded end, opposite the head 150, which projects at the bottom from the central stump 140 of the connection body 14 and on which a nut 153 is screwed to clamp the pin 15 to the connection body 14 itself and therefore for the rigid (firm) connection of the motor 2 to the connection body 14.

The connection body 14 is connected to the frame 12 by means of at least one resilient support element configured to support, in a floating manner, the connection body 14 with respect to the frame 12 inside the housing seat defined by the opening 122, and to allow an oscillation of the connection body 14 itself with respect to the frame 12.

For example, the connection body 14 is connected to the frame 12 by means of at least one spring 16.

In particular, in the illustrated example, the connection body 14 is connected to the frame 12 by means of a plurality of springs 16, for example helical, arranged with radial axis with respect to the connection body 14 itself.

The springs 16 are arranged equally spaced apart and with axis substantially perpendicular to the axis of the connection body 14. In other words, the axes of the springs 16 lay on a plane that in use is adapted for being arranged substantially transversally to a vertical direction.

Each spring 16 comprises a first end fixed to the frame 12 and a second end fixed to the connection body 14.

In particular, in the illustrated example, each first end of the springs 16 is fixed to the second portion 121 of the frame 12 at an inner wall of the through opening 122 (for example through threaded attachment members), and each second end of the springs 16 themselves is fixed to a respective radial projection 141 of the connection body 14.

The springs 16 are configured to allow the oscillation (floating) of the connection body 14 substantially along any direction.

For example, the springs 16 are configured to allow the oscillation of the connection body 14 along any direction substantially perpendicular to the axis of the connection body 14, i.e. a direction parallel to the plane in which the axes of the springs 16 themselves lie (in which the springs 16 are mainly biased by traction/compression).

In particular, the springs 16 are configured to allow the oscillation of the connection body 14 along a substantially vertical direction, i.e. substantially transversal to the axes of the springs 16 themselves (in which the springs 16 are biased mainly by shearing as well as by traction/compression).

In greater detail, the springs 16 are configured so as to allow a vertical oscillation of the connection body 14 that extends below the plane of the lower surface 126 of the second portion 121 of the frame 12.

In other words, the springs 16 are configured so that during the oscillation of the connection body 14 with respect to the frame 12, the interspace 17 is cancelled (disappears, i.e. becomes of zero axial thickness) and the connection body at least partially projects beyond the plane of the lower surface 126 of the second portion 121 of the frame 12

The shoulder support 1 also comprises at least one abutment element connected to one from the connection body 14 and the frame 12 and configured to limit the oscillation of the connection body 14 with respect to the frame 12.

In particular, the abutment element is configured to limit the oscillation of the connection body 14 along a substantially vertical direction, i.e. substantially transversal to the axes of the springs 16.

In practice, in use, the abutment element is configured to limit the oscillation of the connection body 14 in a vertical direction, for example coinciding with the direction of the weight force acting on the motor 2.

In the illustrated example, the abutment element comprises a plate 17 fixed to the frame 12, in particular to the second portion 121 thereof.

In greater detail, the plate 17 is fixed to the second portion 121 so as to be vertically aligned with the through opening 122 and so as to be arranged, in use, along the trajectory followed by the connection body 14 during the oscillation with respect to a substantially vertical direction.

In practice, the plate 17 is arranged so as to partially block the through opening 122.

Moreover, the plate 17 is fixed below the second portion 121 of the frame 12 on the side, i.e. on the opposite side with respect to the motor 2, so that the connection body 14 is arranged between the plate 17 and the motor 2.

In other words, the plate 17 is fixed to the lower surface 126 of the second portion 121 of the frame 12.

In the illustrated example, the plate 17 is arranged substantially zero distance from the lower surface 126 of the second portion 121 of the frame 12 and thus is separated from the connection body 14 by the interspace 17.

The plate 17 is arranged a minimum distance from the connection body 14 comprised between 3 and 6 mm, for example 4.4 mm; such a distance is defined with respect to a rest position of the connection body 14 taken up by it when the motor 2 is turned off and/or when the motor 2 is released from the connection body 14 itself.

In other words, when the motor 2 is turned off and/or when the motor 2 is released from the connection body 14 the axial dimension of the interspace 127 (i.e. along a direction parallel to the axis of the through opening 122) is comprised between 3 and 6 mm, for example 4.4 mm.

The plate 17 is shaped like a circular ring comprising a plurality of radial appendages 170 that allow the attachment to the frame 12.

In the illustrated example, the radial appendages 170, of which there are three, are equally angularly spaced apart so as to cover a straight angle overall, and are respectively fixed to the prongs 123 and to the curved cross member 124 of the second portion 121 of the frame 12.

The radial appendages 170 are adapted for being fixed to the (lower surface 126 of the) second portion 121 of the frame 12 by means of suitable fastening members 172.

In particular, the fastening members 172 are of the releasable type like for example threaded members.

According to other embodiments, the plate 17 could be fixed to the frame 12 in a removable manner, for example it could be made in a single body with the frame 12.

The plate 17 also comprises a central through hole 171, equipped with an axis substantially parallel to the axis of the through opening 122, which allows access to the connection body 14.

The central hole 171 of the plate 17 is arranged coaxial to the connection body 14, for example to the pin 15 and has for example a greater diameter than the maximum diameter of the nut 153 so as to allow access to the connection body 14 by an operator, in particular to allow the attachment of the nut 153 to the pin 15.

According to other embodiments that are not illustrated, the abutment element could comprise at least one body, for example a resilient buffer, fixed to the upper surface 125 of the second portion 121 of the frame 12, i.e. on the same side as the motor 2 with respect to the frame 12, so as to be arranged between the frame 12 itself and the motor 2.

Moreover, according to other embodiments that are not illustrated, the abutment element could be fixed at the top to the connection body 14, for example so as to project above the upper surface 125 of the second portion 121 of the frame 12 (i.e. arranged between the motor 2 and the connection body 14) and go into abutment with it during the oscillation of the connection body 14.

The invention thus conceived can undergo numerous modifications and variants, all of which are covered by the inventive concept.

Moreover, all of the details can be replaced by other technically equivalent elements.

In practice, the materials used, as well as the contingent shapes and sizes, can be whatever according to requirements without for this reason departing from the scope of protection of the following claims.

The invention claimed is:

1. Shoulder support (1) for a motor (2) comprising:

a back-plate (10) which is configured for being associated with the back of an operator through shoulder straps (11) and comprises a shaped body to come into contact with the back of the operator to which a frame (12) is fixed, said frame being substantially L-shaped and comprising a first portion (120), fixed to the back-plate (10), and a second portion (121) which is configured to be connected to a motor (2), is undercut with respect to the first portion (120) and comprises a through opening (122) with substantially vertical through axis, a connection body (14) adapted for being rigidly connected to the motor (2) and a resilient support element adapted for connecting the connection body (14) to the frame (12) in a floating manner inside a seat defined by the through opening (122), wherein the resilient support element comprises a plurality of springs (16), having axes, which lay on a plane that is adapted for being arranged transversally to a vertical direction, and wherein the shoulder support (1) comprises an abutment element (17) configured to limit an oscillation of the connection body (14) with respect to the frame (12) along a direction transversal to the axes of the springs (16).

2. The shoulder support (1) according to claim 1, wherein the abutment element (17) is configured to limit the oscillation of the connection body (14) with respect to a substantially vertical direction.

3. The shoulder support (1) according to claim 1, wherein the frame (12) is L-shaped and comprises a first portion (120) and a second portion (121) undercut with respect to the first portion (120), and wherein the connection body (14) and the abutment element (17) are connected to the second portion (121).

4. The shoulder support (1) according to claim 3, wherein the second portion (121) of the frame (12) comprises a through opening (122) and wherein the connection body (14) is vertically aligned with the through opening (122), the abutment element (17) being configured to at least partially block the through opening (122).

5. The shoulder support (1) according to claim 3, wherein the abutment element (17) is fixed to the second portion (121) of the frame (12) on an opposite side with respect to the motor (2).

6. The shoulder support (1) according to claim 1, wherein the abutment element (17) is arranged at a distance from the connection body (14) between 3 mm and 6 mm.

7. The shoulder support (1) according to claim 1, wherein the abutment element comprises a plate (17) fixed to the frame (12).

8. The shoulder support (1) according to claim 7, wherein the plate (17) is equipped with a central hole (171).

9. The shoulder support (1) according to claim 1, wherein the plurality of springs (16) are arranged with radial axis with respect to the connection body (14) itself and each spring (16) comprises a first end fixed to the frame (12) and a second end fixed to the connection body (14).

10. A power group comprising a shoulder support (1) according to claim 1 and a motor (2) connected to the connection body (14) of the shoulder support (1).

* * * * *